US007734199B2

(12) United States Patent
Mastie et al.

(10) Patent No.: US 7,734,199 B2
(45) Date of Patent: Jun. 8, 2010

(54) CHECKING AND CONDITIONAL PROCESSING OF A PRINT JOB PRINTED WITH MULTIPLE TRANSFER MEDIA

(75) Inventors: Scott David Mastie, Longmont, CO (US); Stephen Dale Hanna, Longmont, CO (US)

(73) Assignee: InfoPrint Solutions Company LLC, Boulder, CO (US)

( * ) Notice: Subject to any disclaimer, the term of this patent is extended or adjusted under 35 U.S.C. 154(b) by 556 days.

(21) Appl. No.: 11/379,038

(22) Filed: Apr. 17, 2006

(65) Prior Publication Data

US 2007/0242961 A1 Oct. 18, 2007

(51) Int. Cl.
*G03G 15/00* (2006.01)

(52) U.S. Cl. ..... 399/15; 399/27; 399/28; 399/29; 399/30; 399/49

(58) Field of Classification Search ..... 399/15, 399/27–30, 49
See application file for complete search history.

(56) References Cited

U.S. PATENT DOCUMENTS 4,563,086 A 1/1986 Knapp et al.
4,901,114 A 2/1990 Parker et al.
4,924,263 A 5/1990 Bares
4,965,613 A 10/1990 Morris et al.
4,972,655 A * 11/1990 Ogawa ..... 53/155
5,036,362 A 7/1991 Stelter
5,276,487 A 1/1994 Akinaga et al.
5,337,122 A 8/1994 Hubble, III et al.
5,341,193 A 8/1994 Hubble, III et al.
6,104,891 A 8/2000 Maebashi et al.
6,137,967 A * 10/2000 Laussermair et al. ..... 399/16
6,151,967 A 11/2000 McIntosh et al.
6,236,816 B1 5/2001 Warbus et al.
6,324,353 B1 11/2001 Laussermair et al.
2002/0176719 A1 * 11/2002 Yogome et al. ..... 399/81
2003/0035672 A1 * 2/2003 Kidani et al. ..... 400/74
2004/0062558 A1 4/2004 Crichton (Continued)

FOREIGN PATENT DOCUMENTS

JP 2002216070 A * 8/2002

OTHER PUBLICATIONS

JP publication 2002-216070; Nakajima, et al.; published Aug. 2, 2002.*

*Primary Examiner*—David M Gray
*Assistant Examiner*—Geoffrey T Evans
(74) *Attorney, Agent, or Firm*—Blakely, Sokoloff, Taylor & Zafman LLP

(57) ABSTRACT

Provided are a method, system and program for checking and conditional processing of a print job printed with multiple transfer media. A print job indicates first print content to print using a first transfer medium and second print content to print using a second transfer medium. The first print content is printed onto a print medium with the first transfer medium. The printed first print content is read to determine whether the printed first print content satisfies a quality requirement. The second print content is printed onto the print medium with the second transfer medium in response to determining that the quality requirement is satisfied. Information is printed indicating an error on the print medium in response to determining that the print quality requirement is not satisfied.

9 Claims, 5 Drawing Sheets

U.S. PATENT DOCUMENTS

2004/0133516 A1* 7/2004 Buchanan et al. ..... 705/42
2005/0097046 A1* 5/2005 Singfield ..... 705/42
2005/0129300 A1* 6/2005 Sandison et al. ..... 382/137

* cited by examiner

Print Job Information

Transmitted Print Job Information

CHECKING AND CONDITIONAL PROCESSING OF A PRINT JOB PRINTED WITH MULTIPLE TRANSFER MEDIA

BACKGROUND OF THE INVENTION

1. Field of the Invention

The present invention relates to checking and conditional processing of a print job printed with multiple transfer media.

2. Description of the Related Art

Print jobs sometimes require that the content be printed with different transfer media, such as toner, liquid ink, magnetic toner, etc. For instances, the bank account information on checks is often printed with Magnetic Ink Character Recognition (MICR) toner and the other content of a check, such as the graphical design, payee, amount and other information, is printed with toner or ink. For certain important documents, printing errors may prevent the processing of the financial transaction represented by the printed document, i.e., the return of the printed check. The document may be rejected for printing errors if the wrong transfer medium is used, such as if the wrong toner is loaded, i.e., magnetic toner is not loaded, or if there are mechanical problems with the print heads, imperfections in the print medium, etc. Printing errors in important financial documents may result in serious customer satisfaction problems and loss of business for the printer customer if the financial instrument is rejected due to a printing error.

One solution to the above print error problems is to print the entire document using MICR toner. However, this solution is costly because the MICR toner is typically more expensive than non-MICR toner. Another solution is to have a person manually verify the check content, which may substantially increase the time and cost to process the checks. Another solution is to perform "spot checks" of the printed checks by having a person review every Nth check to catch print errors that may be recurring in a batch run. This technique does not guarantee the quality of checks that are not reviewed.

For these reasons, there is a need in the art for improved techniques for print processing that can avoid errors when multiple types of transfer media are used for a print job.

SUMMARY

Provided are a method, system and program for checking and conditional processing of a print job printed with multiple transfer media. A print job indicates first print content to print using a first transfer medium and second print content to print using a second transfer medium. The first print content is printed onto a print medium with the first transfer medium. The printed first print content is read to determine whether the printed first print content satisfies a quality requirement. The second print content is printed onto the print medium with the second transfer medium in response to determining that the quality requirement is satisfied. Information is printed indicating an error on the print medium in response to determining that the print quality requirement is not satisfied.

DETAILED DESCRIPTION

Figure 1:
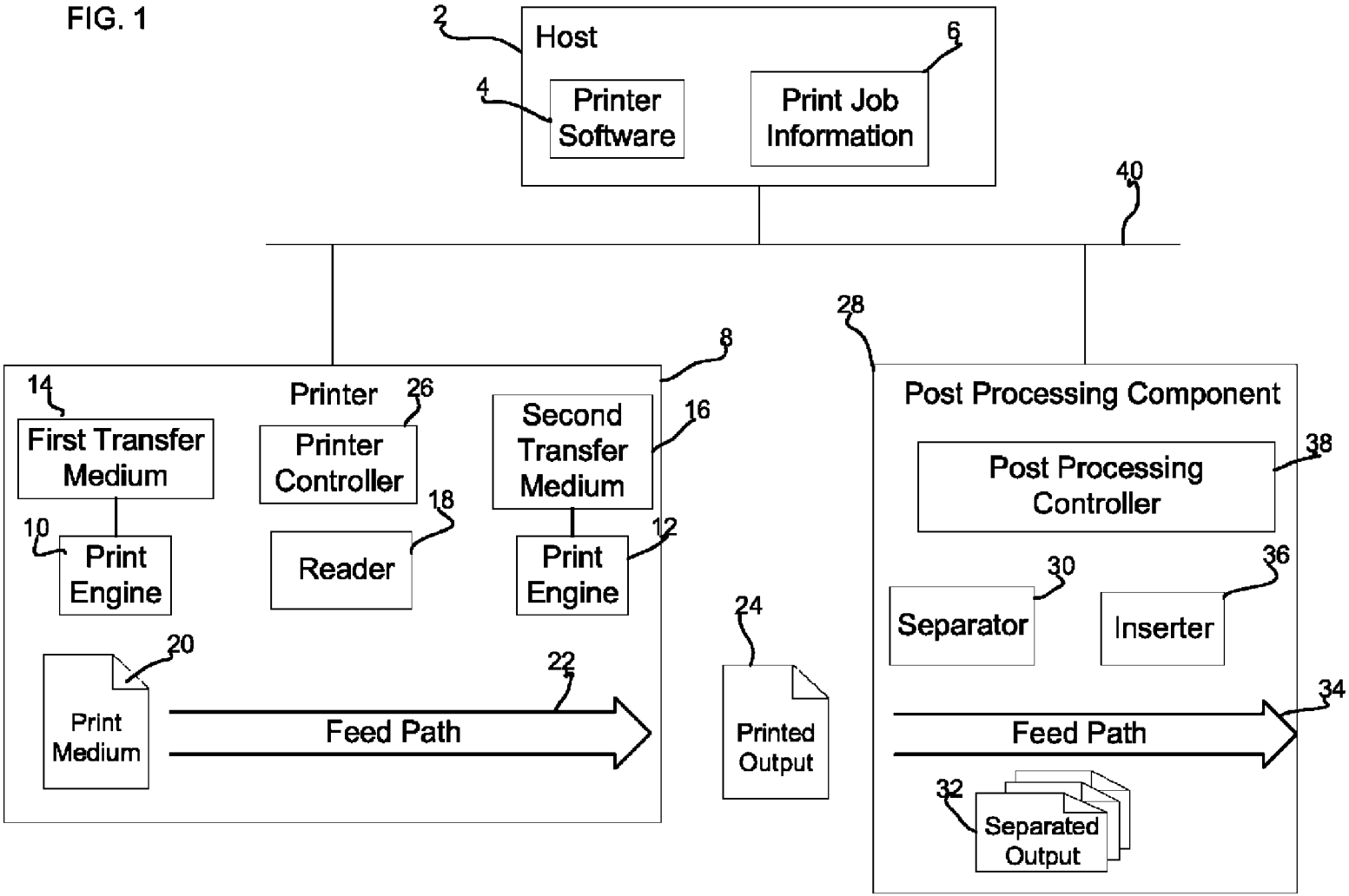
FIG. 1 illustrates an embodiment of a printing environment.

FIG. 1 illustrates an embodiment of a printing environment including a host system 2 having print software 4 to manage print jobs and to maintain print job information 6 on the status of print jobs managed by the print software. The term print job as used herein refers a print job or any component thereof, including a page of print content, a page including multiple print items or elements, such as checks, pages, an element on a page, etc. The print job may further comprise one or more pages, where each page has one or more elements, e.g., checks. A page may comprise a unit of print output, where the page may be outputted on a single piece of paper or multiple pages may be outputted on a roll, ribbon or web of paper. Pages may be outputted on a web of paper in different formats, such as 2-up duplex. Each of the pages on a web or roll of paper may include multiple elements. The web of paper may contain print jobs, where each print job is one or more pages, and where each page includes one or more elements. In this way, elements and pages may be grouped in print jobs.

The host system 2 may include a processor (not shown) and memory (not shown) in which the print software 4 and print job information 6 is stored for access by the processor. The host system 2 may communicate print jobs to a printer 8, where each print job may have one or more pages or elements, and where each page may have one or more elements. The printer 8 includes a first 10 and second 12 print engines to print output using a first 14 and second 16 types of transfer media and a reader 18 capable of reading content printed using the first transfer medium 14. A transfer media 14 and 16 comprises the material or energy that is used to cause the formation of content on the print medium 20, such as toner, liquid ink, solid ink, dye, wax, heat (which when applied to thermal paper produces the print content), etc. A print medium 20, such as a piece of paper or other material or textile, is directed through a feed path 22 by mechanical components of the printer 8, such as rollers, guides, etc. In the feed path 22, the first print engine 10 prints first content of the one or more pages of one or more print jobs on the print medium 20 using the first transfer medium 14. The first content that is printed may comprise an element, a page, a page of elements, etc.

The reader 18 reads the printed first print content to determine the quality of the output. The reader 18 may read each element on one or more pages to determine the quality of each outputted element. The reader 18 forwards the print medium 20 to the second print engine 12 to print second content using the second transfer medium 16 to produce printed output 24 comprising one or more print jobs of one or more pages having one or more elements printed using both types 14 and 16 of transfer media. The printer 8 may include a printer controller 26 to control printing operations and interface with the printer software 4 to execute the commands form the printer software 4 and provide feedback thereto. The print engines 10 and 12 comprise the hardware and/or software to control the printing of content using the first 14 and second 16 types of transfer media, respectively.

In certain embodiments, each job may have job specific error handling options specified in the job header. Default options might be provided by the printer 8 setup/layout. Further, error handling can be overridden on the printer 8 to allow the elements of jobs to be printed with errors if the job handling specified is not possible on a particular setup. Moreover, the reader 18 determine print quality values that are a member of a range of more than two quality result values instead of just a pass or fail value. Moreover, the print job can specify a range of error handling options based on a range of quality values the reader 8 determines.

FIG. 1 shows one print engine 10 before the reader 18 checks the quality of the print output. In additional embodiments, there may be one or more additional print engines that print content before the reader 18 checks the quality, such that the first print content comprises output from multiple engines. For instance, there may be one print engine 10 or station for each color to be printed, e.g., CMYK, or multiple monochrome print engines or stations that apply medium before the quality check. Additionally, there may be multiple readers performing different checking operations of the output by the one or more print engines. In embodiments where there are multiple print engines printing content before the quality check, the reader 18 may check the quality of content from some or all of the print engines printing content before the reading operation.

The printed output 24 is forward to a post processing component 26 which performs various post processing operations on the printed output 28. In one embodiment, the print processing component 28 includes a separator 30 to physically separate the printed output 24 into multiple pieces comprising separated output 32, each piece including one or more print jobs. Each instance of separated output 32 of the printed output 24 may then be forwarded along a feed path 34 to an inserter 36 to insert the separated output 32 content into an envelope and/or to perform additional post processing on the separated output 32. The additional post processing performed on the separated output 32 pieces may comprise stapling, collating, printing, labeling, etc. The post processing component 28 then outputs the separated output 32 in a final form, which may comprise envelopes including the separated output 32 pieces. The post processing component 28 may include a post processing controller 38 to control post processing operations and interface with the printer controller 26 and printer software 4 to execute the commands from the printer software 4 and provide feedback thereto.

An interface 40 provides intercommunication among the host 2, the printer 8, and the post processing component 20. The interface 40 may comprise a network, such as a Local Area Network (LAN), a Wide Area Network (WAN), a wireless network, etc. Alternatively, the interface 40 may comprise a bus interface, parallel interface, serial interface, or other direct line connection. In the embodiment of FIG. 1, the host 2, printer 8, and post processing component 20 are shown as included in separate boxes. In an alternative implementation, the printer 8 and post processing component 20 may be included in a single machine connected via one connection to the host 2. Alternatively, all three devices 2, 8, and 20 may be included in one machine.

Figure 2:
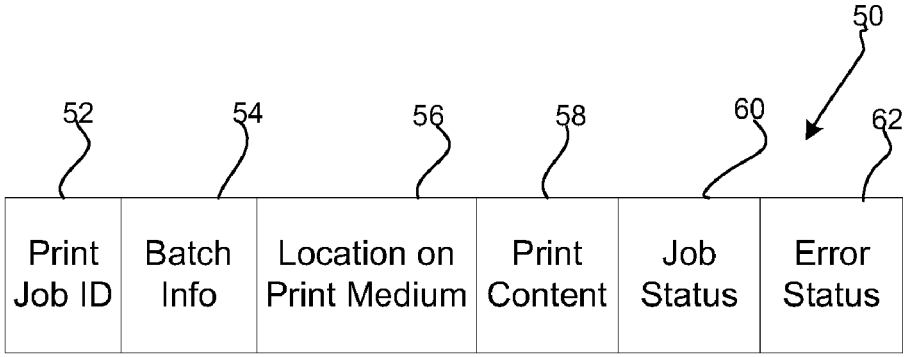
FIG. 2 illustrates an embodiment of print job information.

FIG. 2 illustrates an embodiment of print job information 50 maintained for one print job with the print job information 6. The print job information 50 for one print job includes a print job identifier (ID) 52 identifying the print job; batch information 54 indicating a batch of print jobs including the print job 52, such that print jobs in the batch 54 may be printed together on a same print medium 20, continuous sheet of paper, etc.; location information 56 indicating the location of the print job 52 on the print medium 20 if multiple print jobs are printed on the print medium 20, such as a sequence number or physical location number; print content 58 of information to print as part of the print job; job status 60 indicating the current status or state of the print job; and error status 62 indicating if there was an error in printing the print job. There may be a separate print job information 50 instance for each page or element in the print job. In one embodiment, the cumulative print job information 6 may comprise a database, where each instance of print job information 50 comprises a record in the database. For instance, the print jobs may be managed as part of a workflow management environment, where the nodes in the workflow comprise the different stations, e.g., print engines 10, 12 or post processing engines, e.g., 30, 36, that process the print job.

In one embodiment, the print jobs may comprise checks to print that are printed as part of a batch run on a single continuous sheet. The separator 30 then separates the print medium 20 including the batch print job into separate pieces of paper, one for each check that are then forwarded to the inserter 36 to insert one or more checks into an envelope.

The first 14 and second 16 types of transfer media may differ. For instance, the first transfer medium 14 may comprise magnetized toner to print characters having a magnetic signature that can be read and processed. For instance, if the print jobs comprise checks, then the magnetized toner forms the checking account information used to process the check. The second transfer medium 16 may comprise non-magnetic toner or ink used to print second content. For instance, for a check, the second content printed using the second transfer medium 16 may comprise the payee information, date, amount, graphic designs, etc.

In the embodiment of FIG. 1, the print engines 10 comprise separate print engines. In an alternative embodiment, a single print engine may print content for a print job using the first 14 and second 16 transfer media.

Figure 3:
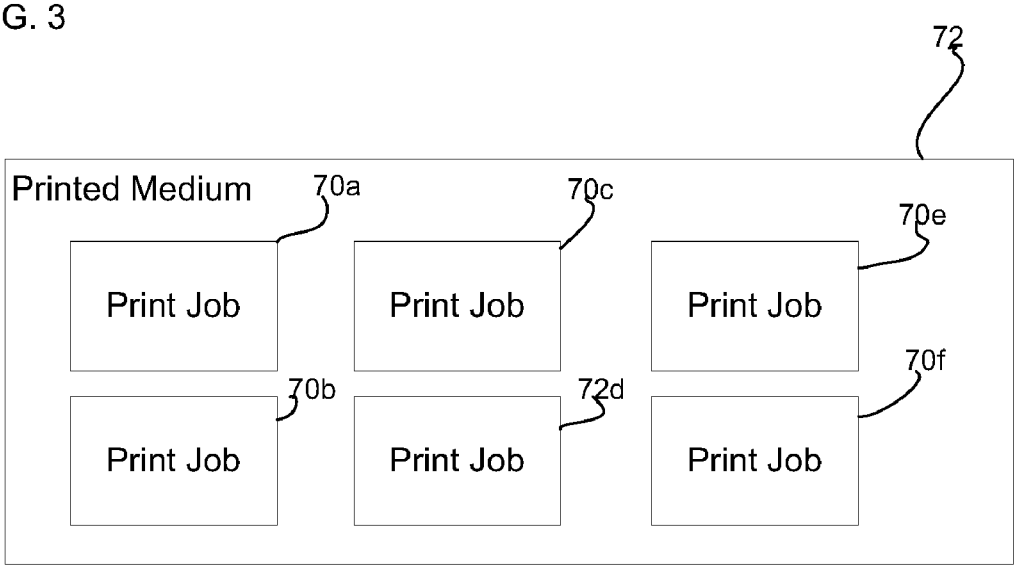
FIG. 3 illustrates an embodiment of printed output.

FIG. 3 illustrates an embodiment where the multiple print jobs 70*a*, 70*b*, 70*c*, 70*d*, 70*e* are printed in batch on one print medium 72. Each print job may comprise one or more pages, where each page may have one or more elements. Alternatively, FIG. 3 can be viewed as one print job with multiple pages 70*a* . . . 70*e*, where each page may have one or more elements.

Figure 4:
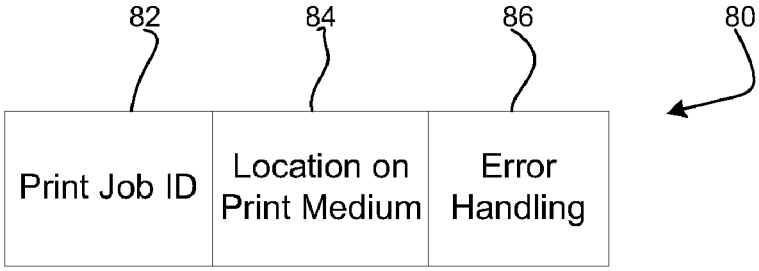
FIG. 4 illustrates an embodiment of transmitted print job information sent to a post processing component.

FIG. 4 illustrates an embodiment of transmitted print job information 80 the printer software 4 generates and transmits to the post processing controller 38 for the post processing controller 38 to use to determine how to process the print jobs. The transmitted print job information 80 identifies a print job 82, which may include batch information; a location 84 on the print medium 20 of the print job, e.g., sequence number, physical position, etc.; and error handling 84 information. For instance, the error handling information 84 may instruct the post processing controller 38 to divert print jobs having the error status to an error stack and not to forward to the inserter 36 to insert into an envelope or perform other post processing. For instance, a single element may be diverted or a page including one element with an error can be diverted, even if other elements do not have an error. In one embodiment, the printer software 4 may provide a single file to the post processing controller 38 for one batch of print jobs 70*a* . . . 70*e* printed on a print medium 72 that indicates each print job 70*a* . . . 70*e* having an error that requires special error handling, such as diversion to a rejected output stack.

Figure 5:
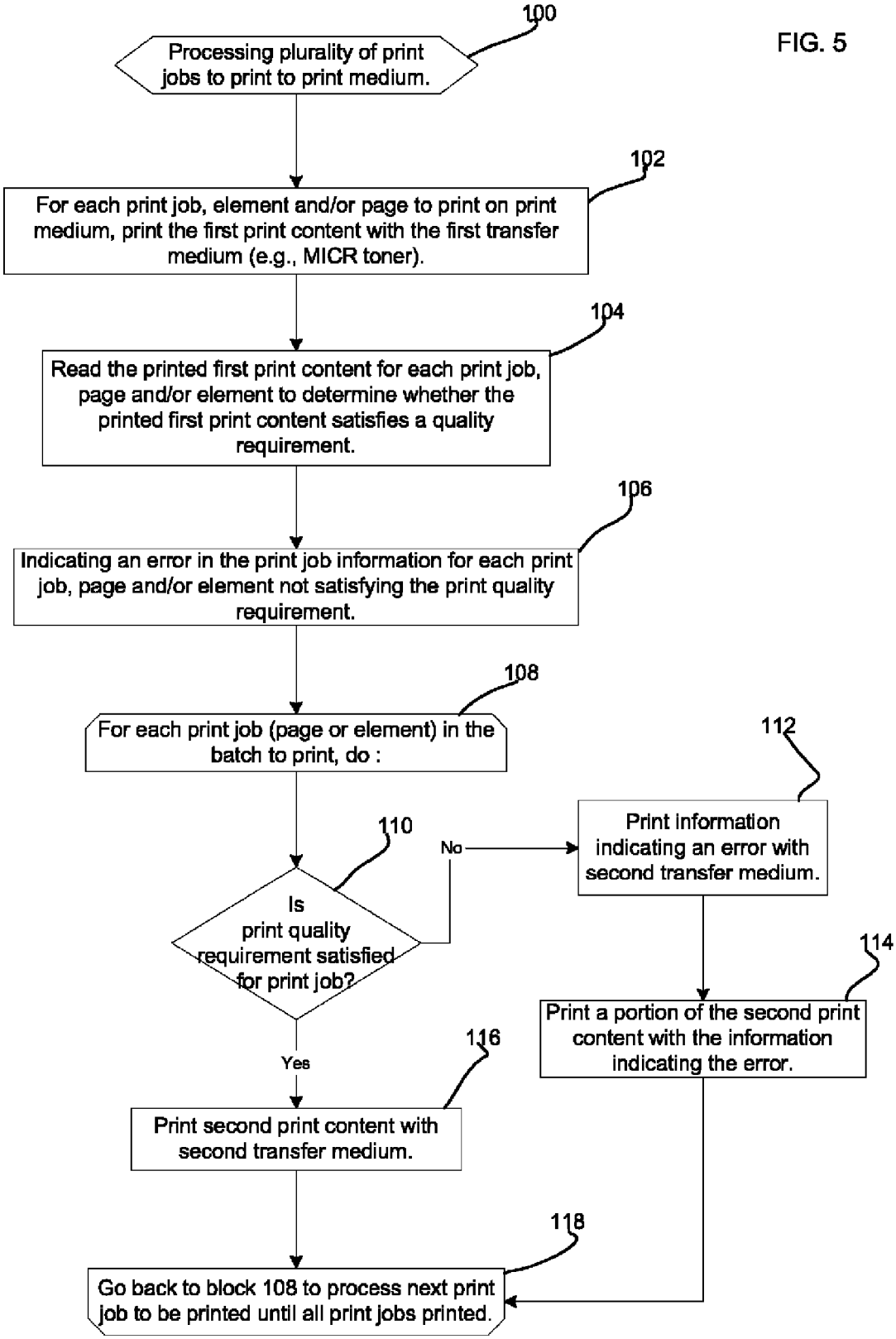
FIG. 5 illustrates an embodiment of operations to process a print job using multiple transfer media.

FIG. 5 illustrates an embodiment of operations performed by the print software 4 and/or the printer controller 26 to generate commands to cause printing using the first 14 and second 16 types of transfer media. Upon processing (at block 100) a plurality of print jobs to print in batch to the print medium 20, for each print job to print on the print medium 20, such as for each print job included in a batch 54 (FIG. 2), the printer software 4 and/or printer controller 26 instructs the first print engine 10 (and any additional print engines) to print (at block 102) first print content (e.g., a page, page of elements, element, etc.) of the print content 58 with the first transfer medium 14 (e.g., MICR toner). As discussed, the first print engine 10 may print one or more print jobs 70*a* . . . 70*f* on the print medium 72. The print medium 20 would then be directed along the feed path 22 to the reader 18, which reads (at block 104) the printed first print content for each print job 70*a* . . . 70*f* on the print medium 72 to determine whether the printed first print content satisfies a quality requirement. The printer software 4 may determine quality by comparing the content read by the reader 18 with the actual first content printed by the print engine 10. In one embodiment, the print quality requirement is satisfied if the known first print content matches the read content of the print job, whose location on the print medium 20 is identified in the location 56 (FIG. 2) information. The quality requirement may permit a degree of permissible error or no margin of error may be permitted. The printer software 4 indicates (at block 106) an error 62 in the print job information 50 for each print job 52 not satisfying the print quality requirement. In this way, the print job information 6 is updated with information on the status and state of the printing at the printer 26.

The printer software 4 and/or printer controller 26 performs a loop of operations at blocks 108 through 118 for each print job in the batch 54 (FIG. 2) to print on the print medium 20. There may be one or more print jobs to print on the print medium 20. If (at block 110) the print quality requirement is not satisfied for the print job being considered in the current iteration of the loop, which may be indicated in the error status 62 of the print job information 50 (FIG. 2) for the print job, then the printer software 4 and/or printer controller 26 issues command(s) to the second print engine 12 to print (at block 112) information indicating an error with the second transfer medium 16. The error indication may be printed on a page, on each element of a page, or any other part of a print job. The print engine 12 may further be instructed to print (at block 114) all or a portion of the second print content with the information indicating the error. If (at block 110) the print quality requirement is satisfied, as indicated in error status 62 field, then the second print engine 12 is instructed to print (at block 116) second print content with the second transfer medium 16, without printing any error information. For instance, if the elements on each page comprise checks, then the print engine 12 may print the words "non-negotiable" or "void" on those checks that do not satisfy the print quality requirement so they are not mailed or used.

With the described embodiment of FIG. 5, the content printed with the second transfer medium 16 is conditional on the outcome of the content printed with the first transfer medium 14.

Figure 6:
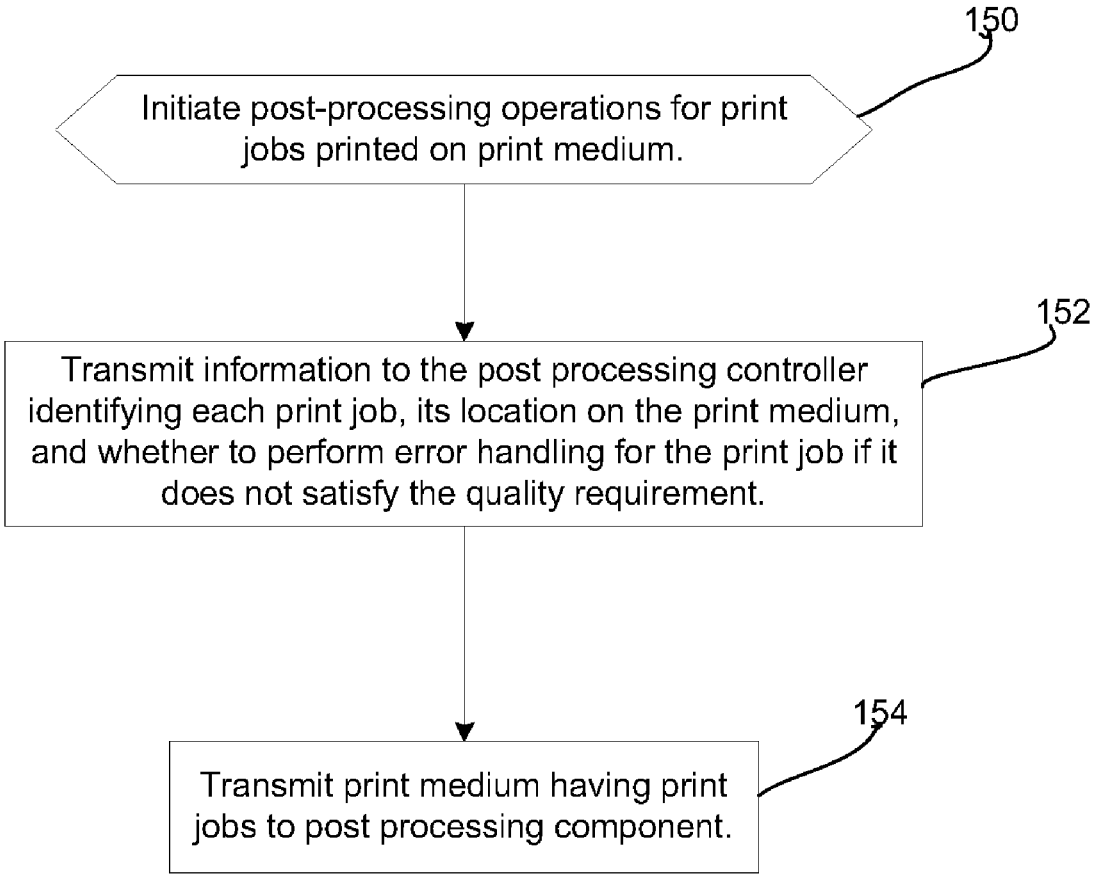
FIG. 6 illustrates an embodiment of operations to initiate post processing of the printed output.

FIG. 6 illustrates operations performed by the printer software 4 upon initiating (at block 150) post-processing operations on the printed output 24 (FIG. 1), which may comprise print jobs 70*a* . . . 70*f* printed on the print medium 72 (FIG. 3). The printer software 4 may transmit (at block 152) transmitted print job information 80 (FIG. 4) to the post processing controller 28 identifying each print job 82 (page, element on a page, etc), its location 84 on the print medium 24, and information 86 indicating whether to perform error handling for the print job (page, element on page, etc.) if it does not satisfy the quality requirement. The printer software 4 and/or printer controller 26 then causes the print output 24 having the printed print jobs to be forwarded (at block 154) to the post processing component 28 feed path 34. The feed path 22 of the printer 8 may be physically coupled to the feed path 34 of the post processing component 28 to move the printed output 24 to the post processing component 28. Alternatively, an operator may have to manually transfer the printed output 24 from the printer 8 to the post processing component 28.

Figure 7:
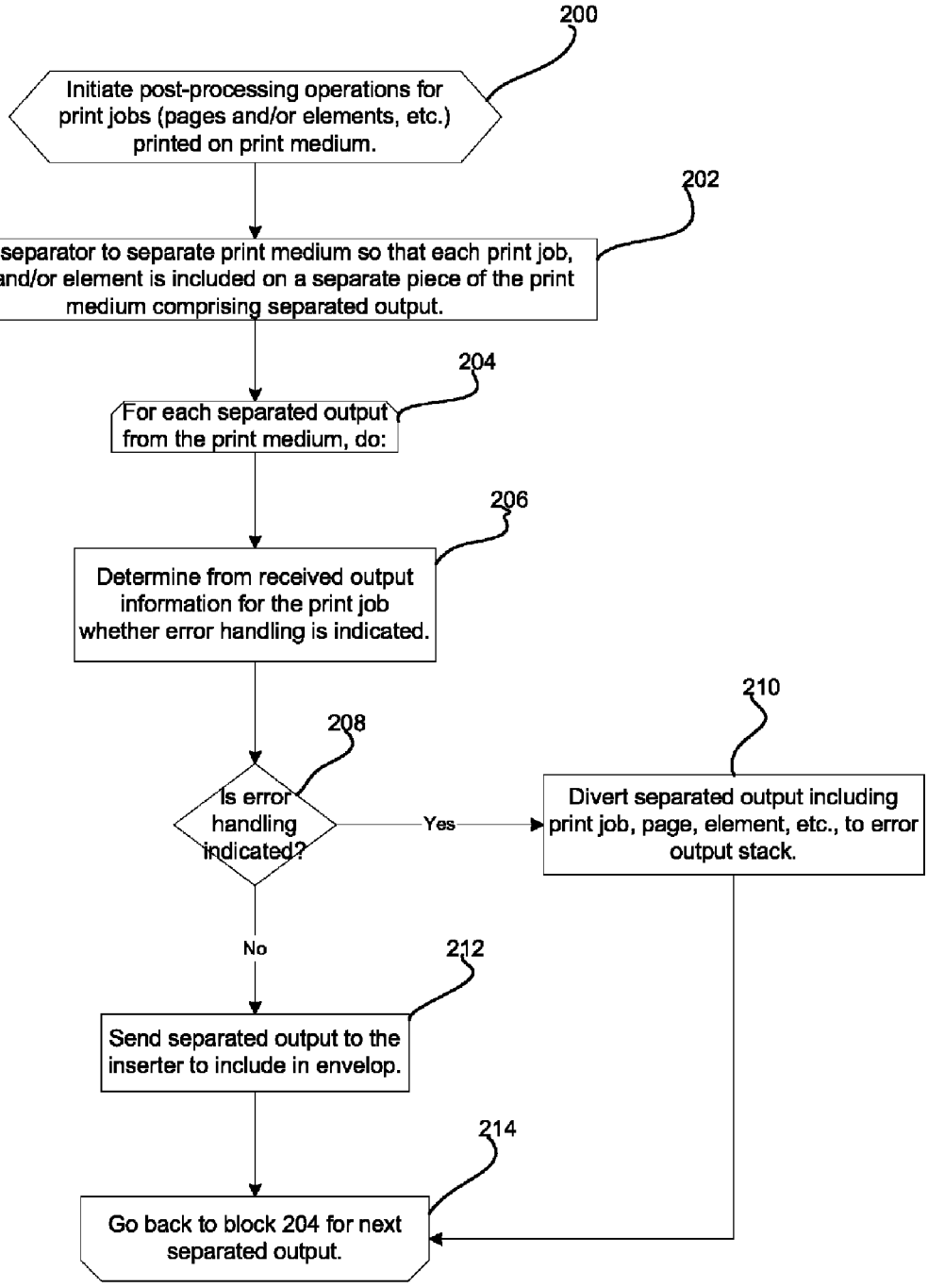
FIG. 7 illustrates an embodiment of operations to perform post processing operations on the printed output.

FIG. 7 illustrates an embodiment of operations performed by the post processing controller 38 or printer software 4 controlling the post processing component 28 to perform post processing related operations on printed output 24 (FIG. 1) including one or more print jobs, e.g., 70*a* . . . 70*f*. Upon initiating (at block 200) post-processing operations for print jobs printed on the printed output 24, the printed output 24 proceeds along the feed path 34 to the separator 30 to separate (at block 202) the printed output 24 into separated outputs 32, each output 32 including one or more print jobs, e.g., pages, elements on a page, etc. The post processing controller 38 then performs the loop of operations at blocks 204 through 214 for each separated output 32, where each separated piece includes content from one or more print jobs. At block 206, the post processing controller 38 determines from transmitted print job information 80 (FIG. 4) received from the printer software 4 whether error handling is indicated, i.e., whether an error is indicated in error handling field 86 for the print job 82 being processed. If (at block 208) error handling is indicated, then the post processing controller 38 sends commands to divert (at block 210) the separated output 32 including the print job pages or elements to an error output stack. For instance, if the separated output being processed comprises a check (i.e., element) having a printing error, such as an error in the MICR content, then that check is diverted to an output stack to be further processed. Alternatively, a page having one element with an error can be diverted. For instance, information can be sent to the printer controller 26 to resend any diverted checks, elements, pages or print jobs that did not print properly. If (at block 208) no error is indicated, then the post processing controller 38 sends commands to forward (at block 212) the separated output 32 to the inserter 36 to insert into an envelope. From blocks 210 or 212, control proceeds (at block 214) back to block 204 if there are further separated outputs 32 to process.

With the described embodiments, the outcome or quality of printing a print job, such as a page, element on a page, etc., using a first transfer medium determines how content is printed with a second transfer medium and how a post processing component processes the print job. In described embodiments, a reader is incorporated into the printing process so that subsequent printing and post-processing related operations are determined by the quality or outcome of the content printed using the first transfer media.

Additional Embodiment Details

The described operations may be implemented as a method, apparatus or article of manufacture using standard programming and/or engineering techniques to produce software, firmware, hardware, or any combination thereof. The described operations may be implemented as code maintained in a "computer readable medium", where a processor may read and execute the code from the computer readable medium. A computer readable medium may comprise media such as magnetic storage medium (e.g., hard disk drives, floppy disks, tape, etc.), optical storage (CD-ROMs, DVDs, optical disks, etc.), volatile and non-volatile memory devices (e.g., EEPROMs, ROMs, PROMs, RAMs, DRAMs, SRAMs, Flash Memory, firmware, programmable logic, etc.), etc. The code implementing the described operations may further be implemented in hardware logic (e.g., an integrated circuit chip, Programmable Gate Array (PGA), Application Specific Integrated Circuit (ASIC), etc.). Still further, the code implementing the described operations may be implemented in "transmission signals", where transmission signals may propagate through space or through a transmission media, such as an optical fiber, copper wire, etc. The transmission signals in which the code or logic is encoded may further comprise a wireless signal, satellite transmission, radio waves, infrared signals, Bluetooth, etc. The transmission signals in which the code or logic is encoded is capable of being transmitted by a transmitting station and received by a receiving station, where the code or logic encoded in the transmission signal may be decoded and stored in hardware or a computer readable medium at the receiving and transmitting stations or devices. An "article of manufacture" comprises computer readable medium, hardware logic, and/or transmission signals in which code may be implemented. A device in which the code implementing the described embodiments of operations is encoded may comprise a computer readable medium or hardware logic. Of course, those skilled in the art will recognize that many modifications may be made to this configuration without departing from the scope of the present invention, and that the article of manufacture may comprise suitable information bearing medium known in the art.

The terms "an embodiment", "embodiment", "embodiments", "the embodiment", "the embodiments", "one or more embodiments", "some embodiments", and "one embodiment" mean "one or more (but not all) embodiments of the present invention(s)" unless expressly specified otherwise.

The terms "including", "comprising", "having" and variations thereof mean "including but not limited to", unless expressly specified otherwise.

The enumerated listing of items does not imply that any or all of the items are mutually exclusive, unless expressly specified otherwise.

The terms "a", "an" and "the" mean "one or more", unless expressly specified otherwise.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described does not necessarily indicate a requirement that the steps be performed in that order. The steps of processes described herein may be performed in any order practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article or a different number of devices/articles may be used instead of the shown number of devices or programs. The functionality and/or the features of a device may be alternatively embodied by one or more other devices which are not explicitly described as having such functionality/features. Thus, other embodiments of the present invention need not include the device itself.

The illustrated operations of FIGS. 5, 6, and 7 show certain events occurring in a certain order. In alternative embodiments, certain operations may be performed in a different order, modified or removed. Moreover, steps may be added to the above described logic and still conform to the described embodiments. Further, operations described herein may occur sequentially or certain operations may be processed in parallel. Yet further, operations may be performed by a single processing unit or by distributed processing units.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method, comprising:

processing a print job indicating first print data to print using a first transfer medium and second print data to print using a second transfer medium;

printing the first print data onto a print medium with the first transfer medium to generate first print content;

reading the first print content;

comparing the first print data with the read first print content to determine whether the first print content satisfies a quality requirement;

printing the second print data onto the print medium with the second transfer medium in response to determining that the quality requirement is satisfied to generate second print content; and printing information indicating an error with the second transfer medium on the print medium in response to determining that the quality requirement is not satisfied.

2. The method of claim 1, further comprising:

printing a portion of the second print content with the information indicating the error in response to determining that the print quality requirement is not satisfied.

3. The method of claim 1, further comprising:

transmitting information to a post-processing component to perform error handling of the print medium including print content in response to determining that the print quality requirement is not satisfied.

4. The method of claim 3, wherein the post-processing component comprises an inserter that inserts the print medium including print content into an envelope, wherein the handling comprises diverting the print medium having the content so that the print medium is not inserted into the envelope.

5. The method of claim 1, wherein the first print content comprises an element of the print job, wherein multiple elements are indicated in the print job, and wherein operations of printing the first and second print contents, reading the printed first print content, and printing information indicating the error are performed with respect to each print element to be printed on the print medium as part of the print job.

6. The method of claim 5, further comprising:

transmitting information to a post-processing component to perform error handling with respect to each element on the print medium for which the error is indicated and the quality requirement is not satisfied.

7. The method of claim 6, wherein the transmitted information identifies each printed element on the print medium indicated as having the error, further comprising:

separating the print medium so that each element is included on a separate piece of the print medium;

diverting each piece of the print medium including one element indicated as having the error; and inserting each piece of the print medium including one element satisfying the quality requirement into an envelope.

8. The method of claim 5, wherein the first transfer medium comprises magnetized toner used to print Magnetic Ink Character Recognition (MICR) characters and the second transfer medium type comprises a transfer medium that is not magnetized, wherein each element comprises a check including payee and amount information, and wherein each piece of the print medium including one element comprises a check, further comprising:

printing the payee and amount information with the information indicating the error for each element determined not to satisfy the print quality requirement.

9. The method of claim 1, further comprising:

using at least one additional transfer medium to print content onto the print medium, wherein the first print content comprises output printed by the first and the at least one additional transfer medium.

* * * * *